US009862898B2

(12) United States Patent
Ward et al.

(10) Patent No.: US 9,862,898 B2
(45) Date of Patent: Jan. 9, 2018

(54) PROCESS AND INSTALLATION FOR THE CONVERSION OF CRUDE OIL TO PETROCHEMICALS HAVING AN IMPROVED BTX YIELD

(71) Applicants: SAUDI BASIC INDUSTRIES CORPORATION, Riyadh (SA); SABIC GLOBAL TECHNOLOGIES B.V., Bergen op Zoom (NL)

(72) Inventors: Andrew Mark Ward, Stockton-on-Tees (GB); Ravichander Narayanaswamy, Bangalore (IN); Vijayanand Rajagopalan, Bangalore (IN); Arno Johannes Maria Oprins, Maastricht (NL); Egidius Jacoba Maria Schaerlaeckens, Geleen (NL); Raul Velasco Pelaez, Maastricht (NL)

(73) Assignees: Saudi Basic Industries Corporation, Riyadh (SA); Sabic Global Technologies B.V., Bergen op Zoom (NL)

( * ) Notice: Subject to any disclaimer, the term of this patent is extended or adjusted under 35 U.S.C. 154(b) by 15 days.

(21) Appl. No.: 14/901,876

(22) PCT Filed: Jun. 30, 2014

(86) PCT No.: PCT/EP2014/063858
§ 371 (c)(1),
(2) Date: Dec. 29, 2015

(87) PCT Pub. No.: WO2015/000850
PCT Pub. Date: Jan. 8, 2015

(65) Prior Publication Data

US 2016/0369184 A1 Dec. 22, 2016

(30) Foreign Application Priority Data

Jul. 2, 2013 (EP) ..... 13174763

(51) Int. Cl.
*C07C 4/02* (2006.01)
*C07C 7/10* (2006.01)
(Continued)

(52) U.S. Cl.
CPC ..... *C10G 69/00* (2013.01); *C10G 7/00* (2013.01); *C10G 9/36* (2013.01); *C10G 11/18* (2013.01);
(Continued)

(58) Field of Classification Search
CPC .. C07C 4/02; C07C 7/10; C10G 57/00; C10G 59/00
(Continued)

(56) References Cited

U.S. PATENT DOCUMENTS 2,242,504 A 5/1941 Benedict et al.
2,894,896 A 7/1959 Housam et al.
(Continued)

FOREIGN PATENT DOCUMENTS

EP 0909804 A2 4/1999
GB 735134 A 8/1955
(Continued)

OTHER PUBLICATIONS

Alfke et al. (2007) Oil Refining, Ullmann's Encyclopedia of Industrial Chemistry.
(Continued)

*Primary Examiner* — Thuan D Dang
(74) *Attorney, Agent, or Firm* — Norton Rose Fulbright US LLP

(57) ABSTRACT

The present invention relates to an integrated process to convert crude oil into petrochemical products comprising crude oil distillation, reforming, dearomatization, fluid catalytic cracking and aromatic ring opening, which process comprises: subjecting crude oil to crude oil distillation to
(Continued)

produce naphtha and one or more of kerosene and gasoil; subjecting naphtha to reforming to produce reformer gasoline; subjecting kerosene and/or gasoil to dearomatization to produce a first stream enriched for alkanes and naphthenes and a second stream enriched for aromatics; subjecting the stream enriched for alkanes and naphthenes to pyrolysis to produce a pyrolysis gasoline or to fluid catalytic cracking to produce a FCC gasoline; subjecting the stream enriched for aromatics to aromatic ring opening to produce a ARO gasoline; and subjecting one or more of reformer gasoline, FCC gasoline and ARO gasoline to gasoline treatment to produce BTX. Furthermore, the present invention relates to a process installation to convert crude oil into petrochemical products using the process of the present invention. The process and the process installation of the present invention have an increased production of petrochemicals at the expense of the production of fuels and an improved BTX yield.

20 Claims, 2 Drawing Sheets

(51) Int. Cl.

| | |
|---|---|
| ***C10G 57/00*** | (2006.01) |
| ***C10G 59/00*** | (2006.01) |
| ***C10G 69/00*** | (2006.01) |
| ***C10G 35/00*** | (2006.01) |
| ***C10G 45/44*** | (2006.01) |
| ***C10G 47/00*** | (2006.01) |
| ***C10G 69/04*** | (2006.01) |
| ***C10G 69/06*** | (2006.01) |
| ***C10G 9/36*** | (2006.01) |
| ***C10G 11/18*** | (2006.01) |
| ***C10G 7/00*** | (2006.01) |
| ***C10G 63/06*** | (2006.01) |

(52) U.S. Cl.
CPC ..... *C10G 35/00* (2013.01); *C10G 45/44* (2013.01); *C10G 47/00* (2013.01); *C10G 63/06* (2013.01); *C10G 69/04* (2013.01); *C10G 69/06* (2013.01); *C10G 2400/20* (2013.01); *C10G 2400/30* (2013.01)

(58) Field of Classification Search
USPC ..... 585/319, 400, 804, 803, 49, 62, 78, 106, 585/133
See application file for complete search history.

(56) References Cited

U.S. PATENT DOCUMENTS

| | | | |
|---|---|---|---|
| 3,256,176 | A | 6/1966 | Mills et al. |
| 3,433,848 | A | 3/1969 | Devins et al. |
| 3,556,983 | A | 1/1971 | Kronig et al. |
| 3,702,292 | A | 11/1972 | Burich |
| 3,842,138 | A | 10/1974 | Chahvekilian et al. |
| 4,181,599 | A | 1/1980 | Miller et al. |
| 4,789,457 | A | 12/1988 | Ficher et al. |
| 5,846,402 | A | 12/1998 | Mandal et al. |
| 5,880,325 | A | 3/1999 | Alward et al. |
| 6,067,910 | A | 5/2000 | Theurer et al. |
| 7,813,988 | B2 | 10/2010 | Levin et al. |
| 9,068,125 | B2 | 6/2015 | Diehl et al. |
| 2005/0258073 | A1 | 11/2005 | Oballa et al. |

FOREIGN PATENT DOCUMENTS

| | | | |
|---|---|---|---|
| GB | 784136 | A | 10/1957 |
| WO | 0244306 | A1 | 6/2002 |
| WO | 2007055488 | A1 | 5/2007 |
| WO | 2012135111 | A2 | 10/2012 |

OTHER PUBLICATIONS

Folkins (2000) Benzene, Ullmann's Encyclopedia of Industrial Chemistry.

International Search Report for International Application No. PCT/EP2014/063858; International Filing Date: Jun. 30, 2014; dated Jul. 28, 2014; 4 Pages.

International Union of Pure and Applied Chemistry, "Compendium of Chemical Terminology," Version 2.3.3 (Feb. 23, 2014) 1670 Pages.

Speight (2005) Petroleum Refinery Process, Kirk-Othmer Encyclopedia of Chemical Technology.

Written Opinion of the International Seraching Authority for International Application No. PCT/EP2014/063858; International Filing Date: Jun. 30, 2014; dated Jul. 28, 2014; 5 Pages.

PROCESS AND INSTALLATION FOR THE CONVERSION OF CRUDE OIL TO PETROCHEMICALS HAVING AN IMPROVED BTX YIELD

CROSS REFERENCE TO RELATED APPLICATIONS

This application is a 371 of International Application No. PCT/EP2014/063858, filed Jun. 30, 2014, which claims priority to European Application No. 13174863.6, filed Jul. 2, 2013 which are incorporated herein by reference in their entirety.

FIELD OF THE INVENTION

The present invention relates to an integrated process to convert crude oil into petrochemical products comprising crude oil distillation, reforming, dearomatization, fluid catalytic cracking and aromatic ring opening. Furthermore, the present invention relates to a process installation to convert crude oil into petrochemical products comprising a crude oil distillation unit, a reforming unit, a dearomatization unit, a fluid catalytic cracking unit and an aromatic ring opening unit.

BACKGROUND OF THE INVENTION

It has been previously described that a crude oil refinery can be integrated with downstream chemical plants such as a pyrolysis steam cracking unit in order to increase the production of high-value chemicals at the expense of the production of fuels.

U.S. Pat. No. 3,702,292 describes an integrated crude oil refinery arrangement for producing fuel and chemical products, involving crude oil distillation means, hydrocracking means, delayed coking means, reforming means, ethylene and propylene producing means comprising a pyrolysis steam cracking unit and a pyrolysis products separation unit, catalytic cracking means, aromatic product recovery means, butadiene recovery means and alkylation means in an interrelated system to produce a conversion of crude oil to petrochemicals of about 50% and a conversion of crude oil to fuels of about 50%.

A major drawback of conventional means and methods to integrate oil refinery operations with downstream chemical plants to produce petrochemicals is that such integrated processes still produce significant amounts of fuel. Furthermore, conventional means and methods to integrate oil refinery operations with downstream chemical plants have a relatively low BTX yield in terms of wt-% of crude.

OBJECTS OF THE INVENTION

It was an object of the present invention to provide a means and methods to integrate oil refinery operations with downstream chemical plants which has an increased production of petrochemicals at the expense of the production of fuels. It was furthermore an object of the present invention to provide a means and methods to integrate oil refinery operations with downstream chemical plants which has an improved BTX yield.

SUMMARY OF THE INVENTION

The solution to the above problem is achieved by providing the embodiments as described herein below and as characterized in the claims.

In one aspect, the present invention relates to an integrated process to convert crude oil into petrochemical products. This process is also presented in FIGS. 1 and 2 which are further described herein below.

DETAILED DESCRIPTION

Figure 1:
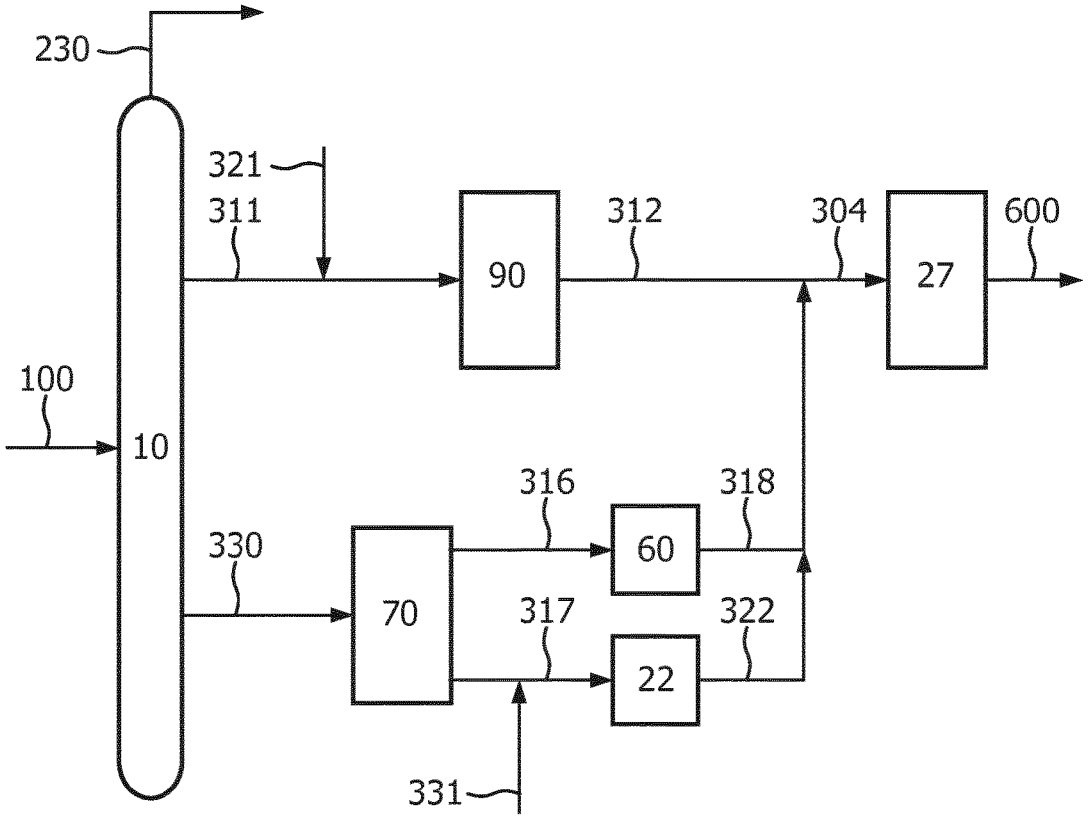
FIG. 1 is an embodiment of the process installation and a process according to the invention as performed in the process installation.

Accordingly, the present invention provides an integrated process to convert crude oil into petrochemical products comprising (a) subjecting crude oil to crude oil distillation to produce naphtha and one or more of kerosene and gasoil;
(b) subjecting naphtha to reforming to produce reformer gasoline;
(c) subjecting kerosene and/or gasoil to dearomatization to produce a first stream enriched for alkanes and naphthenes and a second stream enriched for aromatics;
(d) subjecting the stream enriched for alkanes and naphthenes to pyrolysis to produce a pyrolysis gasoline or to fluid catalytic cracking to produce a FCC gasoline;
(e) subjecting the stream enriched for aromatics to aromatic ring opening to produce ARO gasoline; and
(f) subjecting one or more of reformer gasoline, pyrolysis gasoline, FCC gasoline and ARO gasoline to gasoline treatment to produce BTX.

In the context of the present invention, it was found that the BTX yield of an integrated process to convert crude oil into petrochemical products can be improved by specifically subjecting naphtha to catalytic reforming to produce reformer gasoline, subjecting the naphthenes and alkanes comprised in kerosene and gasoil to pyrolysis or fluid catalytic cracking to produce a pyrolysis gasoline or FCC gasoline, subjecting aromatic hydrocarbon compounds comprised in kerosene and gasoil to aromatic ring opening to produce ARO gasoline. As used herein, the term "BTX yield" relates to the wt-% of BTX produced of the total mass of the crude.

Preferably, the naphtha in step (a) may be combined with refinery unit-derived light-distillate produced in the process. Furthermore, the stream enriched for aromatics in step (d) is preferably combined with refinery unit-derived middle-distillate produced in the process.

The prior art describes processes for producing petrochemical products such as BTX from specific hydrocarbon feeds such as specific crude oil fractions and/or refinery unit-derived distillates.

U.S. Pat. No. 4,181,599 describes a process for upgrading a naphtha-boiling range hydrocarbon to gasoline fuel and BTX comprising separating said naphtha into a light fraction containing C6 aliphatics and lower boiling hydrocarbons and a higher boiling fraction, wherein the higher boiling fraction is subjected to reforming and wherein the heavy reformate thus obtained is subjected to cracking in the presence of a ZSM-5 catalyst. U.S. Pat. No. 4,181,599 does not describe a process for converting crude oil into petrochemical products comprising dearomatization, fluid catalytic cracking and aromatic ring opening. Furthermore, the process of U.S. Pat. No. 4,181,599 is optimized towards high octane gasoline fuels, wherein merely the BTX may be separated from the C5+ fraction produced in the ZSM reaction zone.

The term "crude oil" as used herein refers to the petroleum extracted from geologic formations in its unrefined form. The term crude oil will also be understood to include that which has been subjected to water-oil separations and/or gas-oil separation and/or desalting and/or stabilization. Any crude oil is suitable as the source material for the process of this invention, including Arabian Heavy, Arabian Light, other Gulf crudes, Brent, North Sea crudes, North and West African crudes, Indonesian, Chinese crudes and mixtures thereof, but also shale oil, tar sands, gas condensates and bio-based oils. The crude oil used as feed to the process of the present invention preferably is conventional petroleum having an API gravity of more than 20° API as measured by the ASTM D287 standard. More preferably, the crude oil used in the process of the present invention is a light crude oil having an API gravity of more than 30° API. Most preferably, the crude oil used in the process of the present invention comprises Arabian Light Crude Oil. Arabian Light Crude Oil typically has an API gravity of between 32-36° API and a sulfur content of between 1.5-4.5 wt-%.

The term "petrochemicals" or "petrochemical products" as used herein relates to chemical products derived from crude oil that are not used as fuels. Petrochemical products include olefins and aromatics that are used as a basic feedstock for producing chemicals and polymers. High-value petrochemicals include olefins and aromatics. Typical high-value olefins include, but are not limited to, ethylene, propylene, butadiene, butylene-1, isobutylene, isoprene, cyclopentadiene and styrene. Typical high-value aromatics include, but are not limited to, benzene, toluene, xylene and ethyl benzene.

The term "fuels" as used herein relates to crude oil-derived products used as energy carrier. Unlike petrochemicals, which are a collection of well-defined compounds, fuels typically are complex mixtures of different hydrocarbon compounds. Fuels commonly produced by oil refineries include, but are not limited to, gasoline, jet fuel, diesel fuel, heavy fuel oil and petroleum coke.

The term "gases produced by the crude distillation unit" or "gases fraction" as used herein refers to the fraction obtained in a crude oil distillation process that is gaseous at ambient temperatures. Accordingly, the "gases fraction" derived by crude distillation mainly comprises C1-C4 hydrocarbons and may further comprise impurities such as hydrogen sulfide and carbon dioxide. In this specification, other petroleum fractions obtained by crude oil distillation are referred to as "naphtha", "kerosene", "gasoil" and "resid". The terms naphtha, kerosene, gasoil and resid are used herein having their generally accepted meaning in the field of petroleum refinery processes; see Alfke et al. (2007) Oil Refining, Ullmann's Encyclopedia of Industrial Chemistry and Speight (2005) Petroleum Refinery Processes, Kirk-Othmer Encyclopedia of Chemical Technology. In this respect, it is to be noted that there may be overlap between the different crude oil distillation fractions due to the complex mixture of the hydrocarbon compounds comprised in the crude oil and the technical limits to the crude oil distillation process. Preferably, the term "naphtha" as used herein relates to the petroleum fraction obtained by crude oil distillation having a boiling point range of about 20-200° C., more preferably of about 30-190° C. Preferably, light naphtha is the fraction having a boiling point range of about 20-100° C., more preferably of about 30-90° C. Heavy naphtha preferably has a boiling point range of about 80-200° C., more preferably of about 90-190° C. Preferably, the term "kerosene" as used herein relates to the petroleum fraction obtained by crude oil distillation having a boiling point range of about 180-270° C., more preferably of about 190-260° C. Preferably, the term "gasoil" as used herein relates to the petroleum fraction obtained by crude oil distillation having a boiling point range of about 250-360° C., more preferably of about 260-350° C. Preferably, the term "resid" as used herein relates to the petroleum fraction obtained by crude oil distillation having a boiling point of more than about 340° C., more preferably of more than about 350° C.

As used herein, the term "refinery unit" relates to a section of a petrochemical plant complex for the chemical conversion of crude oil to petrochemicals and fuels. In this respect, it is to be noted that a unit for olefins synthesis, such as a steam cracker, is also considered to represent a "refinery unit". In this specification, different hydrocarbons streams produced by refinery units or produced in refinery unit operations are referred to as: refinery unit-derived gases, refinery unit-derived light-distillate, refinery unit-derived middle-distillate and refinery unit-derived heavy-distillate. Accordingly, a refinery unit derived distillate is obtained as the result of a chemical conversion followed by a separation, e.g. by distillation or by extraction, which is in contrast to a crude oil fraction. The term "refinery unit-derived gases" relates to the fraction of the products produced in a refinery unit that is gaseous at ambient temperatures. Accordingly, the refinery unit-derived gas stream may comprise gaseous compounds such as LPG and methane. Other components comprised in the refinery unit-derived gas stream may be hydrogen and hydrogen sulfide. The terms light-distillate, middle-distillate and heavy-distillate are used herein having their generally accepted meaning in the field of petroleum refinery processes; see Speight, J. G. (2005) loc.cit. In this respect, it is to be noted that there may be overlap between different distillation fractions due to the complex mixture of the hydrocarbon compounds comprised in the product stream produced by refinery unit operations and the technical limits to the distillation process used to separate the different fractions. Preferably, the refinery-unit derived light-distillate is the hydrocarbon distillate obtained in a refinery unit process having a boiling point range of about 20-200° C., more preferably of about 30-190° C. The "light-distillate" is often relatively rich in aromatic hydrocarbons having one aromatic ring. Preferably, the refinery-unit derived middle-distillate is the hydrocarbon distillate obtained in a refinery unit process having a boiling point range of about 180-360° C., more preferably of about 190-350° C. The "middle-distillate" is relatively rich in aromatic hydrocarbons having two aromatic rings. Preferably, the refinery-unit derived heavy-distillate is the hydrocarbon distillate obtained in a refinery unit process having a boiling point of more than about 340° C., more preferably of more than about 350° C. The "heavy-distillate" is relatively rich in hydrocarbons having condensed aromatic rings.

The term "alkane" or "alkanes" is used herein having its established meaning and accordingly describes acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes") and branched alkanes ("iso-paraffins" or "iso-alkanes") but excludes naphthenes (cycloalkanes).

The term "aromatic hydrocarbons" or "aromatics" is very well known in the art. Accordingly, the term "aromatic hydrocarbon" relates to cyclically conjugated hydrocarbon with a stability (due to delocalization) that is significantly greater than that of a hypothetical localized structure (e.g. Kekulé structure). The most common method for determining aromaticity of a given hydrocarbon is the observation of diatropicity in the 1H NMR spectrum, for example the presence of chemical shifts in the range of from 7.2 to 7.3 ppm for benzene ring protons.

The terms "naphthenic hydrocarbons" or "naphthenes" or "cycloalkanes" is used herein having its established meaning and accordingly describes saturated cyclic hydrocarbons.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

One of the petrochemical products produced in the process of the present invention is BTX. The term "BTX" as used herein relates to a mixture of benzene, toluene and xylenes. Preferably, the product produced in the process of the present invention comprises further useful aromatic hydrocarbons such as ethylbenzene. Accordingly, the present invention preferably provides a process for producing a mixture of benzene, toluene xylenes and ethylbenzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethylbenzene product stream.

As used herein, the term "C# hydrocarbons", wherein "#" is a positive integer, is meant to describe all hydrocarbons having # carbon atoms. Moreover, the term "C#+ hydrocarbons" is meant to describe all hydrocarbon molecules having # or more carbon atoms. Accordingly, the term "C5+ hydrocarbons" is meant to describe a mixture of hydrocarbons having 5 or more carbon atoms. The term "C5+ alkanes" accordingly relates to alkanes having 5 or more carbon atoms.

The process of the present invention involves crude distillation, which comprises separating different crude oil fractions based on a difference in boiling point. As used herein, the term "crude distillation unit" or "crude oil distillation unit" relates to the fractionating column that is used to separate crude oil into fractions by fractional distillation; see Alfke et al. (2007) loc.cit. Preferably, the crude oil is processed in an atmospheric distillation unit to separate gas oil and lighter fractions from higher boiling components (atmospheric residuum or "resid"). In the present invention, it is not required to pass the resid to a vacuum distillation unit for further fractionation of the resid, and it is possible to process the resid as a single fraction. In case of relatively heavy crude oil feeds, however, it may be advantageous to further fractionate the resid using a vacuum distillation unit to further separate the resid into a vacuum gas oil fraction and vacuum residue fraction. In case vacuum distillation is used, the vacuum gas oil fraction and vacuum residue fraction may be processed separately in the subsequent refinery units. For instance, the vacuum residue fraction may be specifically subjected to solvent deasphalting before further processing. Preferably, the term "vacuum gas oil" as used herein relates to the petroleum fraction obtained by crude oil distillation having a having a boiling point range of about 340-560° C., more preferably of about 350-550° C. Preferably, the term "vacuum resid" as used herein relates to the petroleum fraction obtained by crude oil distillation having a boiling point of more than about 540° C., more preferably of more than about 550° C.

As used herein, the term "catalytic reformer unit" or "reformer" relates to a refinery unit in which hydrocarbon molecules in a naphtha and/or light-distillate feedstream is reacted to convert naphthenes and paraffins to a light-distillate that is rich in aromatics ("reformer gasoline"); see Alfke (2007) loc. cit. In the catalytic reforming process hydrocarbons are dehydrogenated to produce significant amounts of byproduct hydrogen gas. Other byproducts are methane and LPG. Generally, catalytic reforming is performed using a supported catalyst comprising a hydrogenation metal, preferably platinum, and a halogen, preferably chlorine, which catalyzes isomerization and cracking reactions. Process conditions suitable for catalytic reforming commonly comprise a process temperature of 400-600° C. and a pressure of 0.3-5 MPa gauge preferably of 0.5-5 MPa gauge.

As used herein, the term "dearomatization unit" relates to a refinery unit for the separation of aromatic hydrocarbons, such as BTX, from a mixed hydrocarbon feed. Such dearomatization processes are described in Folkins (2000) Benzene, Ullmann's Encyclopedia of Industrial Chemistry. Accordingly, processes exist to separate a mixed hydrocarbon stream into a first stream that is enriched for aromatics and a second stream that is enriched for paraffins and naphthenes. A preferred method to separate aromatic hydrocarbons from a mixture of aromatic and aliphatic hydrocarbons is solvent extraction; see e.g. WO 2012135111 A2. The preferred solvents used in aromatic solvent extraction are sulfolane, tetraethylene glycol and N-methylpyrolidone which are commonly used solvents in commercial aromatics extraction processes. These species are often used in combination with other solvents or other chemicals (sometimes called co-solvents) such as water and/or alcohols. Non-nitrogen containing solvents such as sulfolane are particularly preferred. Commercially applied dearomatization processes are less preferred for the dearomatization of hydrocarbon mixtures having a boiling point range that exceeds 250° C., preferably 200° C., as the boiling point of the solvent used in such solvent extraction needs to be lower than the boiling point of the aromatic compounds to be extracted. Solvent extraction of heavy aromatics is described in the art; see e.g. U.S. Pat. No. 5,880,325. Alternatively, other known methods than solvent extraction, such as molecular sieve separation or separation based on boiling point, can be applied for the separation of aromatics, particularly of heavy aromatics, in a dearomatization process.

As used herein, the term "fluid catalytic cracker unit" or "FCC unit" relates to a refinery unit to convert high-boiling, high-molecular weight hydrocarbon fractions of petroleum crude oils to lower boiling point hydrocarbon fractions and olefinic gases. In a FCC unit, cracking takes place generally using a very active zeolite-based catalyst in a short-contact time vertical or upward-sloped pipe called the "riser". Preheated feed is sprayed into the base of the riser via feed nozzles where it contacts extremely hot fluidized catalyst. Preferred process conditions used for fluid catalytic cracking generally include a temperature of 425-700° C. and a pressure of 10-800 kPa gauge. The hot catalyst vaporizes the feed and catalyzes the cracking reactions that break down the high-molecular weight hydrocarbons into lighter components including LPG, light-distillate and middle-distillate. The catalyst/hydrocarbon mixture flows upward through the riser for a few seconds, and then the mixture is separated via cyclones. The catalyst-free hydrocarbons are routed to a main fractionator (a component of the FCC unit for separation into fuel gas, LPG, light-distillate, middle distillate and heavy-distillate). "Spent" catalyst is disengaged from the cracked hydrocarbon vapors and sent to a stripper where it is contacted with steam to remove hydrocarbons remaining in the catalyst pores. The "spent" catalyst then flows into a fluidized-bed regenerator where air (or in some cases air plus oxygen) is used to burn off the coke to restore catalyst activity and also provide the necessary heat for the next reaction cycle, cracking being an endothermic reaction. The "regenerated" catalyst then flows to the base of the riser, repeating the cycle. The process of the present invention may comprise several FCC units operated at different process conditions, depending on the hydrocarbon feed and the desired product slate. As used herein, the term "low-severity FCC" or "refinery FCC" relates to a FCC process that is optimized towards the production of light-distillate that is relatively rich in aromatics ("FCC-gasoline"). As most conventional refineries are optimized towards gasoline production, conventional FCC process operating conditions can be considered to represent low-severity FCC. Preferred process conditions used for refinery FCC generally include a temperature of 425-570° C. and a pressure of 10-800 kPa gauge. As used herein, the term "high-severity FCC" or "petrochemicals FCC" relates to a FCC process that is optimized towards the production of olefins. High-severity FCC processes are known from the prior art and are inter alia described in EP 0 909 804 A2, EP 0 909 582 A1 and U.S. Pat. No. 5,846,402. Preferred process conditions used for high-severity FCC generally include a temperature of 540-700° C. and a pressure of 10-800 kPa gauge.

The "aromatic ring opening unit" refers to a refinery unit wherein the aromatic ring opening process is performed. Aromatic ring opening is a specific hydrocracking process that is particularly suitable for converting a feed that is relatively rich in aromatic hydrocarbon having a boiling point in the kerosene and gasoil boiling point range, and optionally the vacuum gasoil boiling point range, to produce LPG and, depending on the specific process and/or process conditions, a light-distillate (ARO-derived gasoline). Such an aromatic ring opening process (ARO process) is for instance described in U.S. Pat. No. 3,256,176 and U.S. Pat. No. 4,789,457. Such processes may comprise of either a single fixed bed catalytic reactor or two such reactors in series together with one or more fractionation units to separate desired products from unconverted material and may also incorporate the ability to recycle unconverted material to one or both of the reactors. Reactors may be operated at a temperature of 200-600° C., preferably 300-400° C., a pressure of 3-35 MPa, preferably 5 to 20 MPa together with 5-20 wt-% of hydrogen (in relation to the hydrocarbon feedstock), wherein said hydrogen may flow co-current with the hydrocarbon feedstock or counter current to the direction of flow of the hydrocarbon feedstock, in the presence of a dual functional catalyst active for both hydrogenation-dehydrogenation and ring cleavage, wherein said aromatic ring saturation and ring cleavage may be performed. Catalysts used in such processes comprise one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. In this respect, it is to be noted that the term "supported on" as used herein includes any conventional way to provide a catalyst which combines one or more elements with a catalytic support. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("ARO-gasoline") which is relatively rich in hydrocarbon compounds having one aromatic and or naphthenic ring. In the context of the present invention, it is preferred to use an aromatic ring opening process that is optimized to keep one aromatic or naphthenic ring intact and thus to produce a light-distillate which is relatively rich in hydrocarbon compounds having one aromatic or naphthenic ring. A further aromatic ring opening process (ARO process) is described in U.S. Pat. No. 7,513,988. Accordingly, the ARO process may comprise aromatic ring saturation at a temperature of 100-500° C., more preferably 300-500° C., preferably 200-500° C., a pressure of 2-10 MPa together with 5-30 wt-%, preferably 10-30 wt-% of hydrogen (in relation to the hydrocarbon feedstock) in the presence of an aromatic hydrogenation catalyst and ring cleavage at a temperature of 200-600° C., preferably 300-400° C., a pressure of 1-12 MPa together with 5-20 wt-% of hydrogen (in relation to the hydrocarbon feedstock) in the presence of a ring cleavage catalyst, wherein said aromatic ring saturation and ring cleavage may be performed in one reactor or in two consecutive reactors. The aromatic hydrogenation catalyst may be a conventional hydrogenation/hydrotreating catalyst such as a catalyst comprising a mixture of Ni, W and Mo on a refractory support, typically alumina. The ring cleavage catalyst comprises a transition metal or metal sulphide component and a support. Preferably the catalyst comprises one or more elements selected from the group consisting of Pd, Rh, Ru, Ir, Os, Cu, Co, Ni, Pt, Fe, Zn, Ga, In, Mo, W and V in metallic or metal sulphide form supported on an acidic solid such as alumina, silica, alumina-silica and zeolites. By adapting either single or in combination the catalyst composition, operating temperature, operating space velocity and/or hydrogen partial pressure, the process can be steered towards full saturation and subsequent cleavage of all rings or towards keeping one aromatic ring unsaturated and subsequent cleavage of all but one ring. In the latter case, the ARO process produces a light-distillate ("ARO-gasoline") which is relatively rich in hydrocarbon compounds having one aromatic ring. In the context of the present invention, it is preferred to use an aromatic ring opening process that is optimized to keep one aromatic ring intact and thus to produce a light-distillate which is relatively ring in hydrocarbon compounds having one aromatic ring.

As used herein, the term "gasoline treatment unit" or "gasoline hydrotreatment unit" or "GTU" relates to a process wherein an unsaturated and aromatics-rich hydrocarbon feedstream, such as a feedstream comprising one or more of FCC gasoline, ARO-derived gasoline and reformer gasoline, is selectively hydrotreated so that the carbon-carbon double bonds of the olefins and di-olefins comprised in said feedstream are hydrogenated; see also U.S. Pat. No. 3,556,983. Conventionally, a gasoline treatment unit includes a first-stage process to improve the stability of the aromatics-rich hydrocarbon stream by selectively hydrogenating diolefins and alkenyl compounds thus making it suitable for further processing in a second stage. The first stage hydrogenation reaction is carried out using a hydrogenation catalyst commonly comprising Ni and/or Pd, with or without promoters, supported on alumina in a fixed-bed reactor. The first stage hydrogenation is commonly performed in the liquid phase comprising a process inlet temperature of 200° C. or less, preferably of 30-100° C. In a second stage, the first-stage hydrotreated aromatics-rich hydrocarbon stream is further processed to prepare a feedstock suitable for aromatics recovery by selectively hydrogenating the olefins and removing sulfur via hydrodesulfurization. In the second stage hydrogenation a hydrogenation catalyst is commonly used comprising elements selected from the group consisting of Ni, Mo, Co, W and Pt, with or without promoters, supported on alumina in a fixed-bed reactor, wherein the catalyst is in a sulfide form. The process conditions generally comprise a process temperature of 200-400° C., preferably of 250-350° C. and a pressure of 1-3.5 MPa, preferably 2-3.5 MPa gauge. The aromatics-rich product produced by the GTU is then further subject to BTX recovery using conventional solvent extraction. In case the aromatics-rich hydrocarbon mixture that is to be subjected to the gasoline treatment is low in diolefins and alkenyl compounds, such as reformer gasoline, the aromatics-rich hydrocarbon stream can be directly subjected to the second stage hydrogenation or even directly subjected to aromatics extraction. Preferably, the gasoline treatment unit is a gasoline hydrocracking unit as described herein to convert a feedstream that is rich in aromatic hydrocarbons having one aromatic ring into purified BTX.

Preferably at least 50 wt-%, more preferably at least 60 wt-%, even more preferably at least 70 wt-%, particularly preferably at least 80 wt-%, more particularly preferably at least 90 wt-% and most preferably at least 95 wt-% of the combined kerosene and gasoil produced by the crude oil distillation in the process is subjected to dearomatization. Preferably less than 50 wt-%, more preferably less than 40 wt-%, even more preferably less than 30 wt-%, particularly preferably less than 20 wt-%, more particularly preferably less than 10 wt-% and most preferably less than 5 wt-% of the crude oil is converted into fuels in the process of the present invention.

Preferably, the process of the present invention further comprises subjecting resid produced by crude oil distillation to resid upgrading to produce LPG and a resid upgrading liquid effluent.

By specifically subjecting resid to resid upgrading to produce LPG, light-distillate and middle-distillate and by subjecting light-distillate and middle-distillate to hydrocracking to ultimately produce LPG and BTX, the BTX yield and the carbon efficiency of the process of the present invention can be greatly improved.

As used herein, the term "resid upgrading unit" relates to a refinery unit suitable for the process of resid upgrading, which is a process for breaking the hydrocarbons comprised in the resid and/or refinery unit-derived heavy-distillate into lower boiling point hydrocarbons; see Alfke et al. (2007) loc.cit. Commercially available technologies include a delayed coker, a fluid coker, a resid FCC, a Flexicoker, a visbreaker or a catalytic hydrovisbreaker. Preferably, the resid upgrading unit may be a coking unit or a resid hydrocracker. A "coking unit" is an oil refinery processing unit that converts resid into LPG, light-distillate, middle-distillate, heavy-distillate and petroleum coke. The process thermally cracks the long chain hydrocarbon molecules in the residual oil feed into shorter chain molecules.

The feed to resid upgrading preferably comprises resid and heavy-distillate produced in the process. Such heavy-distillate may comprise the heavy-distillate produced by a steam cracker, such as carbon black oil and/or cracked distillate but may also comprise the heavy-distillate produced by resid upgrading, which may be recycled to extinction. Yet, a relatively small pitch stream may be purged from the process.

Preferably, the resid upgrading used in the present invention is resid hydrocracking.

By selecting resid hydrocracking over other means for resid upgrading, the BTX yield and the carbon efficiency of the process of the present invention can be further improved.

A "resid hydrocracker" is an oil refinery processing unit that is suitable for the process of resid hydrocracking, which is a process to convert resid into LPG, light-distillate, middle-distillate and heavy-distillate. Resid hydrocracking processes are well known in the art; see e.g. Alfke et al. (2007) loc.cit. Accordingly, 3 basic reactor types are employed in commercial hydrocracking which are a fixed bed (trickle bed) reactor type, an ebullated bed reactor type and slurry (entrained flow) reactor type. Fixed bed resid hydrocracking processes are well-established and are capable of processing contaminated streams such as atmospheric residues and vacuum residues to produce light- and middle-distillate which can be further processed to produce olefins and aromatics. The catalysts used in fixed bed resid hydrocracking processes commonly comprise one or more elements selected from the group consisting of Co, Mo and Ni on a refractory support, typically alumina. In case of highly contaminated feeds, the catalyst in fixed bed resid hydrocracking processes may also be replenished to a certain extend (moving bed). The process conditions commonly comprise a temperature of 350-450° C. and a pressure of 2-20 MPa gauge. Ebullated bed resid hydrocracking processes are also well-established and are inter alia characterized in that the catalyst is continuously replaced allowing the processing of highly contaminated feeds. The catalysts used in ebullated bed resid hydrocracking processes commonly comprise one or more elements selected from the group consisting of Co, Mo and Ni on a refractory support, typically alumina. The small particle size of the catalysts employed effectively increases their activity (c.f. similar formulations in forms suitable for fixed bed applications). These two factors allow ebullated bed hydrocracking processes to achieve significantly higher yields of light products and higher levels of hydrogen addition when compared to fixed bed hydrocracking units. The process conditions commonly comprise a temperature of 350-450° C. and a pressure of 5-25 MPa gauge. Slurry resid hydrocracking processes represent a combination of thermal cracking and catalytic hydrogenation to achieve high yields of distillable products from highly contaminated resid feeds. In the first liquid stage, thermal cracking and hydrocracking reactions occur simultaneously in the fluidized bed at process conditions that include a temperature of 400-500° C. and a pressure of 15-25 MPa gauge. Resid, hydrogen and catalyst are introduced at the bottom of the reactor and a fluidized bed is formed, the height of which depends on flow rate and desired conversion. In these processes catalyst is continuously replaced to achieve consistent conversion levels through an operating cycle. The catalyst may be an unsupported metal sulfide that is generated in situ within the reactor. In practice the additional costs associated with the ebullated bed and slurry phase reactors are only justified when a high conversion of highly contaminated heavy streams such as vacuum gas oils is required. Under these circumstances the limited conversion of very large molecules and the difficulties associated with catalyst deactivation make fixed bed processes relatively unattractive in the process of the present invention. Accordingly, ebullated bed and slurry reactor types are preferred due to their improved yield of light- and middle-distillate when compared to fixed bed hydrocracking. As used herein, the term "resid upgrading liquid effluent" relates to the product produced by resid upgrading excluding the gaseous products, such as methane and LPG and the heavy-distillate produced by resid upgrading. The heavy-distillate produced by resid upgrading is preferably recycled to the resid upgrading unit until extinction. However, it may be necessary to purge a relatively small pitch stream. From the viewpoint of carbon efficiency, a resid hydrocracker is preferred over a coking unit as the latter produces considerable amounts of petroleum coke that cannot be upgraded to high value petrochemical products. From the viewpoint of the hydrogen balance of the integrated process, it may be preferred to select a coking unit over a resid hydrocracker as the latter consumes considerable amounts of hydrogen. Also in view of the capital expenditure and/or the operating costs it may be advantageous to select a coking unit over a resid hydrocracker.

In case the resid is further fractionated using a vacuum distillation unit to separate the resid into a vacuum gas oil fraction and vacuum residue fraction, it is preferred to subject the vacuum gasoil to vacuum gasoil hydrocracking and the vacuum resid to vacuum resid hydrocracking, wherein the heavy distillate produced by vacuum resid hydrocracking is subsequently subjected to vacuum gasoil hydrocracking. In case the present invention involves vacuum distillation, the vacuum gasoil thus obtained is preferably fed to the aromatic ring opening unit together with one or more other hydrocarbon streams that are relatively rich in aromatic hydrocarbons and which have a boiling point in the kerosene and gasoil boiling point range. Such hydrocarbon streams that are relatively rich in aromatic hydrocarbons and which have a boiling point in the kerosene and gasoil boiling point range may be selected from the group consisting of kerosene, gasoil and middle-distillate. The vacuum residue hydrocracking preferably is slurry resid hydrocracking as defined herein above.

Preferably, the process of the present invention further comprises subjecting the heavy-distillate comprised in the liquid resid upgrading effluent to fluid catalytic cracking to produce FCC gasoline stream that is subjected to gasoline treatment.

By subjecting the liquid resid upgrading effluent to fluid catalytic cracking, the hydrogen consumption of the process of the present invention can be reduced when compared to a process wherein the heavy-distillate produced by resid upgrading is recycled to said resid upgrading to extinction. Furthermore, by selecting a process comprising fluid catalytic cracking, the light-distillate produced by aromatic ring opening can be more efficiently upgraded to petrochemical products.

Preferably, the middle-distillate produced by pyrolysis or fluid catalytic cracking is subjected to aromatic ring opening. For instance, in case the alkanes and naphthenes produced by dearomatization are subjected to pyrolysis, the cracked distillate and carbon black oil is preferably subjected to aromatic ring opening to produce ARO gasoline. In case the alkanes and naphthenes produced by dearomatization are subjected to fluid catalytic cracking, the cycle oil is preferably subjected to aromatic ring opening to produce ARO gasoline. The effect of using this recycle to aromatic ring opening is that the BTX yield and carbon efficiency of the process of the present invention is further improved.

Preferably, the LPG produced by the refinery units is subjected to olefins synthesis to produce olefins. The preferred olefins synthesis method used in the process of the present invention comprises pyrolysis. By specifically selecting pyrolysis as the olefins synthesis method, pyrolysis gasoline is produced which yields additional benzene.

As used herein, the term "unit for olefins synthesis" relates to a unit wherein a process for olefins synthesis is performed. This term includes any process for the conversion of hydrocarbons to olefins including, but not limited to non-catalytic processes such as pyrolysis or steam cracking, catalytic processes such as propane dehydrogenation or butane dehydrogenation, and combinations of the two such as catalytic steam cracking.

As used herein, the term "pyrolysis" or "steam cracking" of a hydrocarbon stream relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is 750-900° C., but the reaction is only allowed to take place very briefly, usually with residence times of 50-1000 milliseconds. Preferably, a relatively low process pressure is to be selected of atmospheric up to 175 kPa gauge. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butane or light naphtha give product streams rich in the lighter polymer grade olefins, including ethylene, propylene, and butadiene. Heavier hydrocarbon feeds (full range and heavy naphtha and gas oil fractions) also give products rich in aromatic hydrocarbons.

To separate the different hydrocarbon compounds produced by steam cracking the cracked gas is subjected to a fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent optional quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light-distillate may be separated from the gases between the compression stages. Also acid gases ($CO_2$ and $H_2S$) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for olefins synthesis.

Preferably, the gasoline treatment unit is a gasoline hydrocracking unit as described herein to convert a feedstream that is rich in aromatic hydrocarbons having one aromatic ring into purified BTX. Accordingly, the gasoline treatment preferably comprises contacting one or more of reformer gasoline, pyrolysis gasoline, FCC gasoline and ARO gasoline in the presence of hydrogen with a hydrocracking catalyst under process under hydrocracking conditions.

As used herein, the term "hydrocracker unit" or "hydrocracker" relates to a refinery unit in which a hydrocracking process is performed i.e. a catalytic cracking process assisted by the presence of an elevated partial pressure of hydrogen; see e.g. Alfke et al. (2007) loc.cit. The products of this process are saturated hydrocarbons, naphthenic (cycloalkane) hydrocarbons and, depending on the reaction conditions such as temperature, pressure and space velocity and catalyst activity, aromatic hydrocarbons including BTX. The process conditions used for hydrocracking generally includes a process temperature of 200-600° C., elevated pressures of 0.2-20 MPa, space velocities between 0.1-10 $h^{-1}$. Hydrocracking reactions proceed through a bifunctional mechanism which requires an acid function, which provides for the cracking and isomerization and which provides breaking and/or rearrangement of the carbon-carbon bonds comprised in the hydrocarbon compounds comprised in the feed, and a hydrogenation function. Many catalysts used for the hydrocracking process are formed by combining various transition metals, or metal sulfides with the solid support such as alumina, silica, alumina-silica, magnesia and zeolites.

Even more preferably, an unsaturated and aromatics-rich hydrocarbon feedstream is first subjected to first-stage hydrogenation as described herein above and the first-stage hydrotreated aromatics-rich hydrocarbon stream is subsequently subjected to gasoline hydrocracking. Selecting a gasoline hydrocracking unit as the gasoline treatment unit has the advantages of a smaller recycle of middle-distillate and/or heavy-distillate to refinery units in the process that are capable of processing such distillates. Furthermore, chemical grade BTX can be separated by simple distillation without the need of solvent extraction methods. A further advantage of selecting gasoline hydrocracking to produce BTX is that less ethylbenzene is produced.

As used herein, the term "gasoline hydrocracking unit" or "GHC" refers to a refinery unit for performing a hydrocracking process suitable for converting a complex hydrocarbon feed that is relatively rich in aromatic hydrocarbon compounds—such as refinery unit-derived light-distillate including, but not limited to, reformer gasoline, FCC gasoline and pyrolysis gasoline (pygas)- to LPG and BTX, wherein said process is optimized to keep one aromatic ring intact of the aromatics comprised in the GHC feedstream, but to remove most of the side-chains from said aromatic ring. Accordingly, the main product produced by gasoline hydrocracking is BTX and the process can be optimized to provide chemicals-grade BTX. Preferably, the hydrocarbon feed that is subject to gasoline hydrocracking comprises refinery unit-derived light-distillate. More preferably, the hydrocarbon feed that is subjected to gasoline hydrocracking preferably does not comprise more than 1 wt-% of hydrocarbons having more than one aromatic ring. Preferably, the gasoline hydrocracking conditions include a temperature of 300-580° C., more preferably of 450-580° C. and even more preferably of 470-550° C. Lower temperatures must be avoided since hydrogenation of the aromatic ring becomes favourable. However, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking conversion rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

Preferably, the gasoline hydrocracking of a hydrocarbon feedstream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ non-aromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1.2-1.6 MPa.

Preferably, gasoline hydrocracking of a hydrocarbon feedstream is performed at a Weight Hourly Space Velocity (WHSV) of 0.1-10 $h^{-1}$, more preferably at a Weight Hourly Space Velocity of 0.2-6 $h^{-1}$ and most preferably at a Weight Hourly Space Velocity of 0.4-2 $h^{-1}$. When the space velocity is too high, not all BTX co-boiling paraffin components are hydrocracked, so it will not be possible to achieve BTX specification by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec BTX without the need for a liquid recycle.

Accordingly, preferred gasoline hydrocracking conditions thus include a temperature of 450-580° C., a pressure of 0.3-5 MPa gauge and a Weight Hourly Space Velocity of 0.1-10 $h^{-1}$. More preferred gasoline hydrocracking conditions include a temperature of 470-550° C., a pressure of 0.6-3 MPa gauge and a Weight Hourly Space Velocity of 0.2-6 $h^{-1}$. Particularly preferred gasoline hydrocracking conditions include a temperature of 470-550° C., a pressure of 1-2 MPa gauge and a Weight Hourly Space Velocity of 0.4-2 $h^{-1}$.

The process of the present invention may require removal of sulfur from certain crude oil fractions to prevent catalyst deactivation in downstream refinery processes, such as catalytic reforming or fluid catalytic cracking. Such a hydrodesulfurization process is performed in a "HDS unit" or "hydrotreater"; see Alfke (2007) loc. cit. Generally, the hydrodesulfurization reaction takes place in a fixed-bed reactor at elevated temperatures of 200-425° C., preferably of 300-400° C. and elevated pressures of 1-20 MPa gauge, preferably 1-13 MPa gauge in the presence of a catalyst comprising elements selected from the group consisting of Ni, Mo, Co, W and Pt, with or without promoters, supported on alumina, wherein the catalyst is in a sulfide form.

In a further embodiment, the process of the present invention further comprises a hydrodealkylation step wherein the BTX (or only the toluene and xylenes fraction of said BTX produced) is contacted with hydrogen under conditions suitable to produce a hydrodealkylation product stream comprising benzene and fuel gas.

The process step for producing benzene from BTX may include a step wherein the benzene comprised in the hydrocracking product stream is separated from the toluene and xylenes before hydrodealkylation. The advantage of this separation step is that the capacity of the hydrodealkylation reactor is increased. The benzene can be separated from the BTX stream by conventional distillation.

Processes for hydrodealkylation of hydrocarbon mixtures comprising C6-C9 aromatic hydrocarbons are well known in the art and include thermal hydrodealkylation and catalytic hydrodealkylation; see e.g. WO 2010/102712 A2. Catalytic hydrodealkylation is preferred in the context of the present invention as this hydrodealkylation process generally has a higher selectivity towards benzene than thermal hydrodealkylation. Preferably catalytic hydrodealkylation is employed, wherein the hydrodealkylation catalyst is selected from the group consisting of supported chromium oxide catalyst, supported molybdenum oxide catalyst, platinum on silica or alumina and platinum oxide on silica or alumina.

The process conditions useful for hydrodealkylation, also described herein as "hydrodealkylation conditions", can be easily determined by the person skilled in the art. The process conditions used for thermal hydrodealkylation are for instance described in DE 1668719 A1 and include a temperature of 600-800° C., a pressure of 3-10 MPa gauge and a reaction time of 15-45 seconds. The process conditions used for the preferred catalytic hydrodealkylation are described in WO 2010/102712 A2 and preferably include a temperature of 500-650° C., a pressure of 3.5-8 MPa gauge, preferably of 3.5-7 MPa gauge and a Weight Hourly Space Velocity of 0.5-2 $h^{-1}$. The hydrodealkylation product stream is typically separated into a liquid stream (containing benzene and other aromatics species) and a gas stream (containing hydrogen, $H_2S$, methane and other low boiling point hydrocarbons) by a combination of cooling and distillation. The liquid stream may be further separated, by distillation, into a benzene stream, a C7 to C9 aromatics stream and optionally a middle-distillate stream that is relatively rich in aromatics. The C7 to C9 aromatic stream may be fed back to reactor section as a recycle to increase overall conversion and benzene yield. The aromatic stream which contains polyaromatic species such as biphenyl, is preferably not recycled to the reactor but may be exported as a separate product stream and recycled to the integrated process as middle-distillate ("middle-distillate produced by hydrodealkylation"). The gas stream contains significant quantities of hydrogen may be recycled back the hydrodealkylation unit via a recycle gas compressor or to any other refinery unit comprised in the process of the present invention that uses hydrogen as a feed. A recycle gas purge may be used to control the concentrations of methane and $H_2S$ in the reactor feed.

Figure 2:
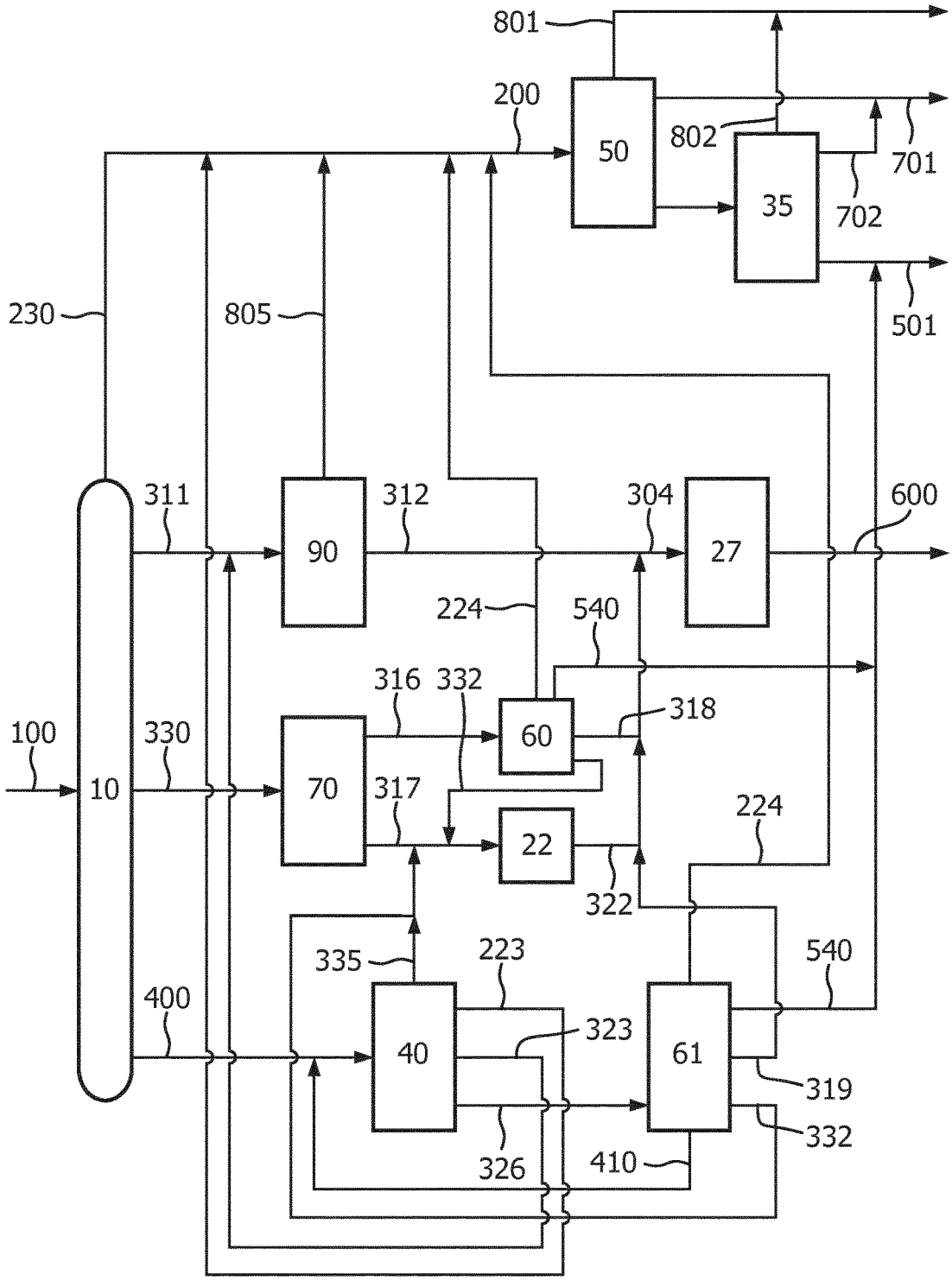
FIG. 2 is an embodiment of a process installation and a process according to the invention as performed in the process installation.

In a further aspect, the present invention also relates to a process installation suitable for performing the process of the invention. This process installation and the process as performed in said process installation are presented in FIGS. 1 and 2 (FIG. 1-2).

Accordingly, the present invention further provides a process installation to convert crude oil into petrochemical products comprising a crude distillation unit (10) comprising an inlet for crude oil (100), an outlet for naphtha (311) and at least one outlet for kerosene and/or gasoil (330);

a reformer unit (90) comprising an inlet for naphtha and an outlet for reformer gasoline (312);

a dearomatization unit (70) comprising an inlet for kerosene and/or gasoil, an outlet for a stream enriched for alkanes and naphthenes (316) and an outlet for a stream enriched for aromatics (317);

a steam cracker or a fluid catalytic cracker (60) comprising an inlet for alkanes and naphthenes produced by dearomatization (316) and an outlet for pyrolysis gasoline or FCC gasoline (318);

an aromatic ring opening unit (22) comprising an inlet for a stream enriched for aromatic produced by dearomatization (317) and an outlet for ARO gasoline (322);

and a gasoline treatment unit (27) comprising an inlet (304) for one or more of reformer gasoline, pyrolysis gasoline, FCC gasoline and ARO gasoline and an outlet for BTX (600). This aspect of the present invention is presented in FIG. 1 (FIG. 1).

The crude distillation unit (10) preferably further comprises an outlet for a gases fraction (230). Preferably, the naphtha (311) that is fed to the reformer unit (90) is combined with refinery unit-derived light-distillate produced in the process (321). Furthermore, the stream enriched for aromatics (317) that is fed to the aromatic ring opening unit is preferably combined with refinery unit-derived middle-distillate produced in the process (331). In case the alkanes and naphthenes produced by dearomatization (316) are fed to a steam cracker (60), the cracked distillate and carbon black oil is preferably subjected to aromatic ring opening via connection (332); see FIG. 2. In case the alkanes and naphthenes produced by dearomatization (316) are fed to a fluid catalytic cracker (60), the cycle oil is preferably subjected to aromatic ring opening via connection (332).

The reformer unit (90) preferably has an outlet for hydrogen (805); see FIG. 2. The hydrogen produced by the catalytic reforming process preferably is collected with the other hydrogen produced in the integrated process. Preferably, the hydrogen produced by the reformer unit (90) is subjected to gas separation in gas separation unit (50) to provide a purified hydrogen stream (801).

As used herein, the term "an inlet for X" or "an outlet of X", wherein "X" is a given hydrocarbon fraction or the like relates to an inlet or outlet for a stream comprising said hydrocarbon fraction or the like. In case of an outlet for X is directly connected to a downstream refinery unit comprising an inlet for X, said direct connection may comprise further units such as heat exchangers, separation and/or purification units to remove undesired compounds comprised in said stream and the like.

If, in the context of the present invention, a refinery unit is fed with more than one feed stream, said feedstreams may be combined to form one single inlet into the refinery unit or may form separate inlets to the refinery unit.

Preferably, the process installation of the present invention further comprises a resid upgrading unit (40) comprising an inlet for resid produced by crude distillation (400) and refinery unit-derived heavy-distillate and an outlet for LPG produced by resid upgrading (223) and an outlet for resid upgrading liquid effluent (326). This aspect of the present invention is presented in FIG. 2 (FIG. 2).

In this embodiment, the crude distillation unit (10) preferably further comprises an outlet for resid (400). The resid produced by the crude oil distillation unit (400) and optionally refinery unit-derived heavy-distillate produced the integrated petrochemical process installation, such as heavy-distillate produced by resid upgrading, may be combined to form one single inlet into the resid upgrading unit (40) or may form two separate inlets to the resid upgrading unit (40). The resid upgrading unit (40) may further comprise an outlet for middle-distillate (335) which is preferably fed to the aromatic ring opening unit (22).

Preferably, the process installation of the present invention further comprises: a fluid catalytic cracker (61) comprising an inlet for heavy-distillate produced by resid upgrading (326) and an outlet for FCC gasoline (319) that is optionally fed to the gasoline treatment unit (27). This aspect of the present invention is presented in FIG. 2 (FIG. 2).

The fluid catalytic cracking unit (61) may further comprise an outlet for a middle-distillate (332) which may be recycled to the aromatic ring opening unit (22). The fluid catalytic cracking unit (61) may further comprise an outlet for heavy-distillate (410) which may be recycled to the resid upgrading unit (40). The fluid catalytic cracking unit (61) may further comprise an outlet for LPG (224) and an outlet for olefins (540).

The gases produced in the process of the present invention, such as methane, LPG and hydrogen, may be collected and fed to a gas separation unit (50) to separate the different components, such as LPG produced by the installation (200), hydrogen (801) and methane (701). This aspect of the present invention is presented in FIG. 2 (FIG. 2).

As used herein, the term "gas separation unit" relates to the refinery unit that separates different compounds comprised in the gases produced by the crude distillation unit and/or refinery unit-derived gases. Compounds that may be separated to separate streams in the gas separation unit comprise ethane, propane, butanes, hydrogen and fuel gas mainly comprising methane. Any conventional method suitable for the separation of said gases may be employed in the context of the present invention. Accordingly, the gases may be subjected to multiple compression stages wherein acid gases such as $CO_2$ and $H_2S$ may be removed between compression stages. In a following step, the gases produced may be partially condensed over stages of a cascade refrigeration system to about where only the hydrogen remains in the gaseous phase. The different hydrocarbon compounds may subsequently be separated by distillation.

Preferably, the process installation of the present invention further comprises a gas cracker (35) comprising an inlet for LPG produced by the installation (200) and an outlet for olefins (501). This aspect of the present invention is presented in FIG. 2 (FIG. 2).

The gas cracker (35) may further comprise an outlet for hydrogen (802) and an outlet for methane (702).

The present invention further provides the use of the process installation according to the present invention for converting crude oil into petrochemical products comprising olefins and BTX.

A further preferred feature of the present invention is that all non-desired products, such as non-high-value petrochemicals may be recycled to the appropriate unit to convert such a non-desired product to either a desired product (e.g. a high-value petrochemical) or to a product that is a suitable as feed to a different unit.

In the process and the process installation of the present invention, all methane produced is collected and preferably subjected to a separation process to provide fuel gas. Said fuel gas is preferably used to provide the process heat in the form of hot flue gases produced by burning the fuel gas or by forming steam. Alternatively, the methane can be subjected to steam reforming to produce hydrogen. Also the undesired side products produced by e.g. steam cracking may be recycled. For instance, the carbon black oil and cracked distillate produced by steam cracking may be recycled to aromatic ring opening.

The different units operated in the process or the process installation of the present invention are furthermore integrated by feeding the hydrogen produced in certain processes, such as in olefins synthesis, as a feedstream to processes that need hydrogen as a feed, such as in hydrocracking. In case the process and the process installation is a net consumer of hydrogen (i.e. during start-up of the process or the process installation or because all hydrogen consuming processes consume more hydrogen than produced by all hydrogen producing processes), reforming of additional methane or fuel gas than the fuel gas produced by the process or the process installation of the present invention may be required.

The following numerical references are used in FIGS. 1-2:

10 crude distillation unit
22 aromatic ring opening unit
27 gasoline treatment unit
35 gas cracker
40 resid upgrading unit
50 gas separation unit
60 fluid catalytic cracker
61 second fluid catalytic cracker
70 dearomatization unit
90 reformer unit
100 crude oil
200 LPG produced by the process installation
223 LPG produced by resid upgrading
224 LPG produced by fluid catalytic cracking
230 gases fraction
304 one or more of reformer gasoline, pyrolysis gasoline, FCC gasoline and ARO gasoline
311 naphtha
312 reformer gasoline
316 alkanes and naphthenes produced by dearomatization
317 stream enriched for aromatics
318 pyrolysis gasoline or FCC gasoline
319 FCC gasoline
321 refinery unit-derived light-distillate produced in the process
322 ARO gasoline
323 resid-upgrading-derived light-distillate
326 resid upgrading-derived liquid effluent
330 kerosene and/or gasoil
331 refinery unit-derived middle-distillate produced in the process
332 cracked distillate and carbon black oil
335 middle-distillate
400 resid
410 heavy-distillate produced by fluid catalytic cracking
501 olefins produced by gas cracker

540 olefins produced by FCC
600 BTX
701 methane produced by gas separation
702 methane produced by gas cracker
801 hydrogen produced by gas separation
802 hydrogen produced by gas cracker
805 hydrogen produced by reformer Although the invention has been described in detail for purposes of illustration, it is understood that such detail is solely for that purpose and variations can be made therein by those skilled in the art without departing from the spirit and scope of the invention as defined in the claims.

It is further noted that the invention relates to all possible combinations of features described herein, preferred in particular are those combinations of features that are present in the claims.

It is noted that the term "comprising" does not exclude the presence of other elements. However, it is also to be understood that a description on a product comprising certain components also discloses a product consisting of these components. Similarly, it is also to be understood that a description on a process comprising certain steps also discloses a process consisting of these steps.

The present invention will now be more fully described by the following non-limiting Examples.

COMPARATIVE EXAMPLE 1

The experimental data as provided herein were obtained by flowsheet modelling in Aspen Plus. The steam cracking kinetics were taken into account rigorously (software for steam cracker product slate calculations). The following steam cracker furnace conditions were applied: ethane and propane furnaces: coil outlet temperature (COT)=845° C. and steam-to-oil-ratio=0.37, C4-furnaces and liquid furnaces: COT=820° C. and Steam-to-oil-ratio=0.37. The dearomatization unit was modeled as a splitter into 2 streams, one stream containing all the aromatic components and the other stream containing all the naphthenic, normal- and iso-paraffinic components. The catalytic reformer unit was modeled based on data from literature.

For the gasoline hydrocracking, a reaction scheme has been used that is based on experimental data.

For the aromatic ring opening a reaction scheme has been used in which all aromatic compounds were converted into BTX and LPG and all naphthenic and paraffinic compounds were converted into LPG. The resid hydrocracker unit and the FCC unit were modelled based on data from literature.

In Comparative Example 1, Arabian light crude oil is distilled in an atmospheric distillation unit. All fractions except the resid are steam cracked. The fractions sent to the steam cracker comprise LPG, naphtha, kerosene and gasoil fractions. The cut point for the resid is 350° C. The total fraction of the crude sent to the steam cracker amounts to 50 wt % of the crude. In the steam cracker the above mentioned crude fractions are being cracked in the furnaces. The results are provided in table 1 as provided herein below.

The products that are derived from the crude oil are divided into petrochemicals (olefins and BTXE, which is an acronym for BTX+ethylbenzene) and other products (hydrogen, methane and heavy fractions comprising C9 resin feed, cracked distillate, carbon black oil and resid). The total amount sums up to 100% of the total crude, since the resid is also taken into account. From the product slate of the crude oil the carbon efficiency is determined as:

(Total Carbon Weight in petrochemicals)/(Total Carbon Weight in Crude).

For the Comparative Example the BTXE yield is 8 wt-% of the total crude.

EXAMPLE 1

Example 1 is identical to the Comparative Example except for the following:

First, the naphtha of the crude distillation is treated in a catalytic reformer unit. The lights from the reformer, containing hydrogen, methane and LPG are sent to the steam cracker, the LPG is steam cracked. The naphtha reformate is sent to the gasoline treatment unit of the steam cracker.

Furthermore, the kerosene and gas oil fractions (cut point 350° C.) of the crude distillation are redistributed in a dearomatization unit into 2 streams, one stream containing all aromatic components, the other stream containing all naphthenes, iso- and normal-paraffins. The stream of aromatic components is subjected to aromatic ring opening that is operated under process conditions to maintain 1 aromatic ring (BTX), while the naphthenic and paraffinic fractions in the feed are converted into LPG (intermediate). This LPG is separated into ethane-, propane- and butane fractions which are being steam cracked. The stream from the dearomatization unit containing all naphthenes, iso- and normal-paraffins is being steam cracked.

Furthermore, the heavy part of the cracker effluent (C9 resin feed, cracked distillate and carbon black oil) is being recycled to the aromatic ring opening unit.

Table 1 as provided herein below displays the total product slate from the steam cracker, in wt-% of the total crude. The table also contains the remaining atmospheric residue fraction.

For Example 1 the BTXE yield is 20 wt-% of the total crude.

EXAMPLE 2

Example 2 is identical to Example 1 except for the following:

First, the resid is upgraded in a resid hydrocracker to produce gases, light-distillate, middle-distillate, heavy-distillate and bottom. The gases produced by resid hydrocracking are steam cracked.

The light-distillate and middle-distillate produced by resid hydrocracking are redistributed in the dearomatization unit into 2 streams, one stream containing all aromatic components, the other stream containing all naphthenes, iso- and normal-paraffins. The stream of aromatic components is subjected to aromatic ring opening that is operated under process conditions to maintain 1 aromatic ring (BTX), while the naphthenic and paraffinic fractions in the feed are converted into LPG (intermediate). This LPG is separated into ethane-, propane- and butane fractions which are steam cracked. The stream from the dearomatization unit containing all naphthenes, iso- and normal-paraffins is steam cracked.

The heavy-distillate and bottom from the hydrocracker is sent to the FCC unit, to produce lights and FCC naphtha. The lights are sent to the steam cracker where the olefins in the lights are separated from the LPG. This LPG is separated into ethane-, propane- and butane fractions, which are steam cracked. The FCC naphtha is sent to the gasoline treatment unit of the steam cracker. The LCO (light cyclic oil) from the FCC unit is recycled to the aromatic ring opening unit.

Table 1 as provided herein below displays the total product slate in wt % of the total crude. The product slate also contains the pitch of the resid hydrocracker and the coke from the FCC unit (4 wt % of the crude).

For Example 2 the BTXE yield is 33 wt-% of the total crude.

EXAMPLE 3

Example 3 is identical to Example 2 except for the following:

The naphtha reformate is subjected to gasoline hydro cracking instead of being sent to the gasoline treatment unit of the steam cracker. Furthermore the FCC naphtha is subjected to gasoline hydro cracking instead of being steam cracked. The GHC unit produces BTX and LPG. This LPG is separated into ethane-, propane- and butane fractions which are steam cracked.

Table 1 as provided herein below displays the total product slate in wt % of the total crude. The product slate also contains the pitch of the resid hydrocracker and the coke from the FCC unit (4 wt % of the crude).

For example 3 the BTXE yield is 32 wt-% of the total crude.

TABLE 1

| | Comparative Example | Example 1 | Example 2 | Example 3 |
|---|---|---|---|---|
| Petrochemicals (wt-% of crude) | | | | |
| Ethylene | 15% | 14% | 24% | 26% |
| Propylene | 8% | 7% | 17% | 16% |
| Butadiene | 2% | 2% | 3% | 3% |
| 1-butene | 1% | 1% | 3% | 3% |
| Isobutene | 1% | 1% | 2% | 2% |
| Isoprene | 0% | 0% | 0% | 0% |
| Cyclopentadiene | 1% | 1% | 1% | 1% |
| Benzene | 4% | 6% | 10% | 11% |
| Toluene | 2% | 8% | 13% | 13% |
| Xylene | 1% | 5% | 8% | 8% |
| Ethylbenzene | 1% | 1% | 2% | 0% |
| Other components (wt-% of crude) | | | | |
| Hydrogen | 1% | 1% | 2% | 2% |
| methane | 7% | 6% | 11% | 11% |
| Heavy components | 56% | 48% | 0% | 0% |
| RHC pitch and FCC coke | 0% | 0% | 4% | 4% |
| Carbon efficiency | 38.0% | 47.2% | 86.1% | 85.7% |

The invention claimed is:

1. An integrated process to convert crude oil into petrochemical products comprising crude oil distillation, reforming, dearomatization, fluid catalytic cracking and aromatic ring opening, which process comprises:

(a) subjecting crude oil to crude oil distillation to produce naphtha and one or more of kerosene and gasoil;

(b) subjecting naphtha to reforming to produce reformer gasoline;

(c) subjecting kerosene and/or gasoil to dearomatization to produce a first stream enriched for alkanes and naphthenes and a second stream enriched for aromatics;

(d) subjecting the stream enriched for alkanes and naphthenes to pyrolysis to produce a pyrolysis gasoline or to fluid catalytic cracking to produce a FCC gasoline;

(e) subjecting the stream enriched for aromatics to aromatic ring opening to produce ARO gasoline;

(f) subjecting one or more of reformer gasoline, pyrolysis gasoline, FCC gasoline and ARO gasoline to gasoline treatment to produce BTX; and (g) subjecting resid produced by crude oil distillation to resid upgrading to produce LPG and a resid upgrading liquid effluent, wherein the resid upgrading is hydrocracking.

2. The process according to claim 1, wherein at least 50 wt-% of the combined kerosene and gasoil produced by the crude oil distillation in the process is subjected to dearomatization.

3. The process according to claim 1, further comprising subjecting heavy-distillate comprised in the liquid resid upgrading effluent to fluid catalytic cracking to produce FCC gasoline stream that is subjected to gasoline treatment.

4. The process according to claim 1, wherein a middle-distillate produced by pyrolysis or fluid catalytic cracking is subjected to aromatic ring opening.

5. The according to claim 1, wherein the LPG is subjected to olefins synthesis to produce olefins.

6. The process according to claim 5, wherein the olefins synthesis comprises pyrolysis.

7. The process according to claim 1, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

8. The process according to claim 2, further comprising subjecting heavy-distillate comprised in the liquid resid upgrading effluent to fluid catalytic cracking to produce FCC gasoline stream that is subjected to gasoline treatment.

9. The process according to claim 2, wherein a middle-distillate produced by pyrolysis or fluid catalytic cracking is subjected to aromatic ring opening.

10. The according to claim 2, wherein the LPG is subjected to olefins synthesis to produce olefins.

11. The process according to claim 10, wherein the olefins synthesis comprises pyrolysis.

12. The process according to claim 2, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

13. The process according to claim 3, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

14. The process according to claim 4, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

15. The process according to claim 5, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

16. The process according to claim 6, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

17. The process according to claim 8, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

18. The process according to claim 9, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

19. The process according to claim 10, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

20. The process according to claim 11, wherein the gasoline treatment is gasoline hydrocracking comprising contacting one or more of reformer gasoline, pyrolysis gasoline, FCC gasoline and ARO gasoline in the presence of hydrogen with a hydrocracking catalyst under process under hydrocracking conditions.

* * * * *